US005125198A

United States Patent [19]

Giumenta et al.

[11] Patent Number: 5,125,198

[45] Date of Patent: Jun. 30, 1992

[54] DUAL FITTING CHIMNEY CAP

[76] Inventors: Fredric Giumenta, 80 Stanford Ct., Wantagh, N.Y. 11793; Frank Giumenta, 11 Thomas Rd., Rockville Centre, N.Y. 11570

[21] Appl. No.: 670,913

[22] Filed: Mar. 18, 1991

[51] Int. Cl.[5] ..... E04H 12/28

[52] U.S. Cl. ..... 52/218; 285/424; 52/199

[58] Field of Search ..... 52/199, 344; 285/424, 285/383, 12, 285, 319, 239; 5/281

[56] References Cited

U.S. PATENT DOCUMENTS

| | | | |
|---|---|---|---|
| 2,563,710 | 8/1951 | Epstein | 98/67 |
| 2,976,796 | 3/1961 | Anthony | 98/67 |
| 4,082,322 | 4/1978 | Lever | 285/424 |

*Primary Examiner*—David A. Scherbel
*Assistant Examiner*—Creighton Smith
*Attorney, Agent, or Firm*—Philip Sands

[57] ABSTRACT

A dual fitting chimney cap adapted to be connected to chimney stacks of differing sizes, the chimney cap including a cylindrical housing having an upper housing portion formed with a plurality of apertures, and a lower housing portion for attachment to an upper open end of a chimney stack of conforming cylindrical contour, the lower housing portion having a cylindrical cross-section of a presecribed diameter, and an annular transition portion integrally interposed between and interconnecting the upper and lower housing portions, the annular transition portion including a first annular region and a second annular region integral with and interconnected to the first annular region, the first annular region having a prescribed diameter larger in dimension than the diameter of the second annular region and also larger in dimension than the diameter of the lower housing portion, the second annular region having a prescribed diameter smaller in dimension than the diameter of the lower housing portion.

The foregoing abstract is neither intended to define the invention disclosed, nor is it intended to be limiting as to the scope in any way.

4 Claims, 2 Drawing Sheets

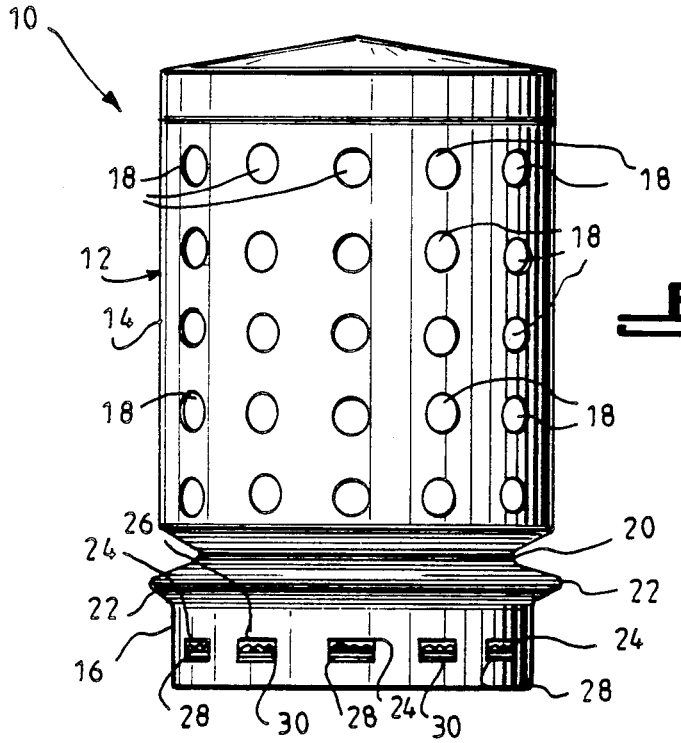
Fig. 1
Fig. 2
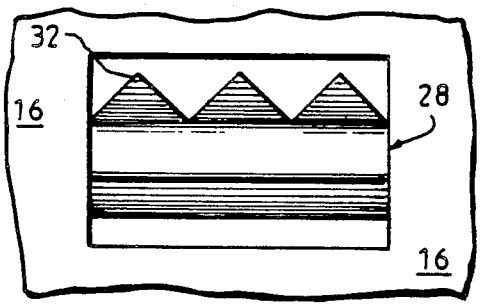
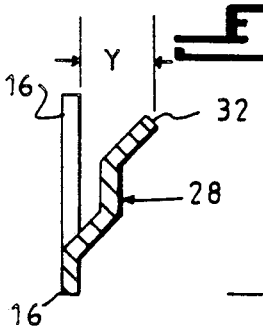
Fig. 3
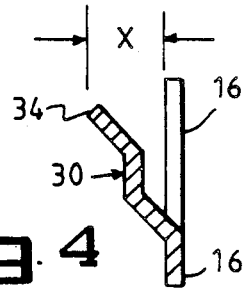
Fig. 4

DUAL FITTING CHIMNEY CAP

BACKGROUND OF THE INVENTION

The present invention relates generally to a chimney cap for protecting the upper open end of a chimney flue or chimney stack from the ingress of undesirable elements in the form of small animals, as well as leaves from overhanging tree limbs and the rain.

It is another object of the present invention to provide a chimney cap which does not interfere with the continuous movement of air through the fireplace and chimney and, thereby, present no obstacle to a continuous and forceful up-draft in the chimney flue.

It is still a further object of the present invention to provide a chimney cap for protecting chimney flues, and that can be installed simply, rapidly, and with a minimum amount of tools and the like.

It is still a further object of the present invention to provide a chimney cap that can be inserted onto the upper open end of a chimney stack, with virtually no need of any tools or moving parts to make the connection, whether the chimney stack is slightly larger in diameter than the chimney cap of the present invention, or slightly smaller in diameter than the chimney cap of the present invention.

It is still another object of the present invention to provide a chimney cap that when installed upon a chimney stack, whether larger or smaller in diameter, will be reliably constrained against inadvertent removal without the need to provide any screws, bolts, or other means of interconnection of the chimney cap to the chimney stack, other then the already in-place, non-movable, parts of the chimney cap.

Further objects and advantages of this invention will become apparent as the following discription proceeds.

SUMMARY OF THE INVENTION

Briefly stated, and in accordance with the present invention, there is provided a chimney cap for protecting the upper open end of a chimney flue or a chimney stack from the ingress of various undesirable elements.

In the preferred embodiment of the present invention, the chimney cap may be characterized as a dual fitting chimney cap adapted to be connected to chimney stacks of different sizes, the chimney cap including a cylindrical housing having an upper housing portion formed with a plurality of apertures, and a lower housing portion for attachment to an upper open end of a chimney stack of conforming cylindrical contour.

The lower housing portion of the chimney cap is provided with a cylindrical cross-section of a prescribed diameter. There is provided a annular transition portion that is integrally interposed between and interconnects the upper and lower housing portions.

The annular transition portion includes a first annular region and a second annular region intergral with and interconnected to the first annular region, the first annular region having a prescribed diameter larger in dimension than the diameter of the second annular region and also larger in dimension than the diameter of the lower housing portion.

The second annular region is provided with a prescribed diameter smaller in dimension than the diameter of the lower housing portion, the first annular region presenting an annular bulge extending outwardly of the cylindrical housing, and is thereby larger in dimension than the diameter of the cylindrical housing, the second annular region presenting an annular bulge extending inwardly of the cylindrical housing, thereby presenting a diameter smaller in dimension than that of the inner diameter of the second annular region of the cylindrical housing.

As a consequence of the provision of the first and second annular regions, one providing a larger dimension and the other a smaller dimension than the exterior and interior, respectively, of the lower portion of the cylindrical housing, the latter may be forced either onto a larger sized upper open end of a chimney stack for frictional engagement by the outer bulge with the interior of the upper open end of a chimney stack, or, on the other hand, forced over a smaller sized upper open end of a chimney stack to be frictionally constrained by the inner bulge.

It is the frictional engagement of the inner bulge or the outer bulge of the annular transition portion of the cylindrical housing that provides for the dual fitting capability of the chimney cap of the present invention with different sized upper open ends of chimney stacks without the otherwise attendent need for the provision of bolts or screws or other fastening elements for interconnecting the chimney cap of the present invention to the upper open end of a given chimney stack of conforming cross-section.

BRIEF DESCRIPTION OF THE DRAWINGS

Other objects and advantages of the present invention will become apparent upon reading the following detailed description and upon reference to the drawings, in which:

FIG. 1 is an elevational view of the chimney cap of the present invention showing a sinusoidal relationship between the inner and outer annular transition regions interposed between the upper and lower cylindrical housing portions;

FIG. 2 is a enlarged elevational view of one of the gripping elements formed as part of the lower housing portion;

FIG. 3 is an enlarged cross-sectional view of an inwardly directed gripping element;

FIG. 4 is a view similar to FIG. 3, but presenting an outwardly directed gripping element;

Figure 5:
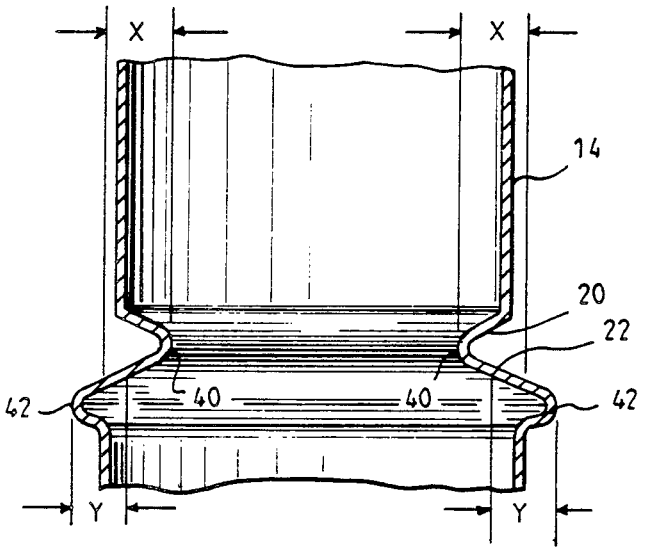
FIG. 5 is an enlarged cross-sectional view of the sinusoidal inner and outer annular regions.

While the present invention will be described in connection with a preferred embodiment, it will be understood that it is not intended to limit the invention to that embodiment. On the contrary, it is intended to cover all alternatives, modifications and equivalents as may be included within the spirit and scope of the invention as defined in the appended claims, for example, without limitation, a chimney cap with a square rather than cylindrical cross-section.

DETAILED DESCRIPTION OF THE INVENTION

With continued reference to the drawing, wherein like reference numerals have been used throughout to designate like elements, the present invention is designated generally by the reference character 10.

The chimney cap of the present invention 10 is in the form of a cylindrical housing 12 having an upper housing portion 14 and a lower housing portion 16 integral with the upper housing portion 14.

Integrally interconnecting the upper housing portion 14 to the lower housing portion 16 is a generally sinusoidal annular transition arrangement comprised of an upper annular region 20 and a lower annular region 22. The sinusoidal annular transition arrangement is best illustrated in FIGS. 1 and 5.

The upper housing portion 14 is provided with a plurality of small perforations or openings 18 through which air may be discharged or exhausted from a chimney stack. On the other hand, the lower housing portion 16 is provided with a circular array of generally retangular openings 24 and 26 which alternate circumferentially of the lower housing portion 16. Associated with each of the openings 24 is an inwardly disposed gripping element 28, whereas, on the other hand, associated with each of the openings 26 is an outwardly projecting gripping element 30.

The gripping elements 28 and 30 are stamped out of the material of the housing 10, preferably a metallic material, so as to present the various openings 24 and 26, the difference between the gripping elements 28 and 30 lying in their respective inward and outward directions of the lower housing portion 16.

Notwithstanding the different directions taken by the gripping element 28 and 30, each is provided with a generally toothed free-end portion, as best illustrated in FIG. 2, denoted by the reference character 32 (FIG. 3) or by the reference character 34 (FIG. 4), the toothed free-end portions 32 being associated with the gripping elements 28, and the toothed free-end portions 34 being associated with the gripping elements 30.

It will be understood that the gripping element 28 and 30 alternate respectively with one another, one inwardly of the lower housing portion 16 and one outwardly of the lower housing portion 16.

As best illustrated in FIG. 3, the toothed free-end portion 32 of each gripping element 28 is spaced from the internal wall of the lower housing portion 16 by a distance Y, whereas, as illustrated in FIG. 4, the toothed free-end portion 34 of each gripping element 30 is spaced by a distance X from the external wall of the lower housing portion 16. For purposes of the present invention, it is preferred that the distances Y and X, illustrated in FIGS. 3 and 4, respectively, be virtually the same.

As best illustrated in FIG. 5, the first or upper annular region 20 presents an internally radially directed annular bulge 40, whereas the lower or second annular region 22 presents an outwardly radially directed annular bulge 42, the bulges 40 and 42 constituting, in elevational cross-section, a sinusoidal arrangement of the contiguous upper and lower annular regions 20 and 22, respectively.

As further illustrated in FIG. 5, the free edge of the inner annular bulge 40 is spaced from the internal wall of the upper housing portion 14 by the prescribed distance X, whereas the free edge of the outer bulge 42 is spaced from the external wall of the lower housing portion 16 by the prescribed distance Y.

In the preferred embodiment of the present invention, the upper and lower housing portions 14 and 16 have identical diameters, and the distances X and Y associated with the bulges 40 and 42 are virtually identical.

In essence, pursuant to a preferred embodiment of the present invention, the bulge 40 is radially directed inwardly by amount that is substantially the same as the amount by which the bulge 42 extends outwardly radially of the lower housing portion 16. The radially directed measurements X and Y associated with the bulges 40 and 42, respectively, are identical to the prescribed dimensions that the toothed free-ends of the gripping members 28 and 30 (FIGS. 3 and 4) are spaced by the distance Y from the internal wall of the lower housing portion 16 and the distance X from the external wall of the lower housing portion 16.

Hence, pursuant to the present invention, the prescribed distances X and Y in FIGS. 3 and 4 are identical to one another and, likewise, identical to the dimensions X and Y of the radially directed bulges 40 and 42 illustrated in FIG. 5.

Notwithstanding the foregoing, while the distances X and Y in FIGS. 3, 4 and 5 are preferred to be substantially equal to one another pursuant to the present invention, the present invention, nevertheless, contemplates that the distances X and Y illustrated in FIGS. 3, 4 and 5 may be different from one another and still provide for an efficient and effective use of the present invention as a chimney cap upon the upper open end of a chimney stack.

Because of the nature of the present invention, it is characterized as a dual fitting chimney cap adapted to be connected to chimney stacks of at least two (2) different sizes, one having a diameter slightly larger than the outer diameter of the lower housing portion 16, and one having a diameter slightly smaller than the internal diameter of the lower housing portion 16.

Figure 6:
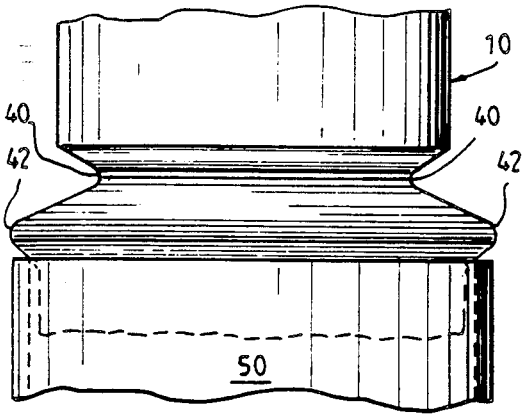
FIG. 6 is a view similar to FIG. 5, but presenting the manner by which the present invention is constrained in a larger sized chimney stack.
Figure 7:
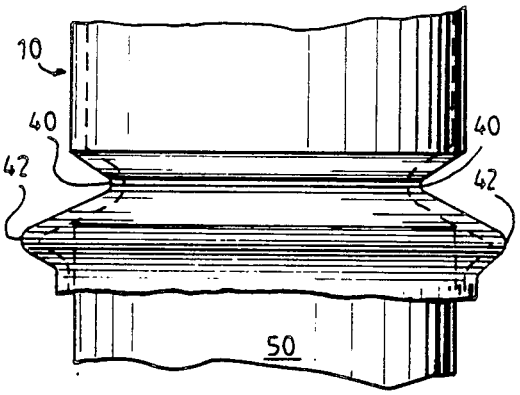
FIG. 7 is a view similar to FIG. 6, but presenting the manner by which the present invention is constrained on a smaller sized chimney stack.

As best illustrated in FIGS. 6 and 7, it will be understood that the present invention can be inserted into the upper open end of a chimney stack 50 having a diameter slightly larger than the external diameter of the lower housing portion 16, the interior surface of the chimney stack 50 being engaged (or near engaged) by the external surface of the lower housing portion 16 of the chimney cap.

What occurs as the lower housing portion 16 penetrates the upper open end of a chimney stack is that the exterior of the lower housing portion 16 slides along the interior of the conforming, cylindrical interior of the chimney stack until the bulge 42 engages the uppermost edge portion of the upper open end of the chimney stack 50.

Upon such engagement, a further forcing of the chimney cap 10 downwardly into the upper open end of the chimney stack 50 causes the bulge 42 to squeeze annularly against the interior of the upper open end of the chimney stack and provide for a tight friction-fit connection of the chimney cap 10 to the upper open end of the chimney stack 50.

With the provision of the outwardly directed gripping elements 30 at the near-bottom of the lower housing portion 16, the latter gripping elements, with their toothed portions 34, act to provide for a stablizing or anchoring means at the lower housing portion 16, and thereby further constrain the chimney cap 10 against inadvertant upward removal from the upper open end of the chimney stack. The gripping elements 34 also cooperate with the bulge 42 to prevent the chimney cap 10 from wobbling relative to the chimney stack 50.

Similarly, when the chimney cap 10 is to be inserted upon (rather than into) the upper open end of a chimney stack having a diameter slighter less than the interior diameter of the lower housing portion 16, the interior of the lower housing portion 16 is caused to slide over the upper open end of a chimney stack 52 (see FIG. 7) until the internal bulge 40 engages the upper edge of the upper open end of the chimney stack 52.

At that juncture, further downward pressure exerted against the chimney cap 10 will cause the internal bulge 40 to annularly squeeze against the exterior of the upper open end of the chimney stack 52, and thereby act to constrain the chimney cap 10 from inadvertant upward movement relative to and removal from the upper open end of the chimney stack 52.

In this instance, however, it is the internally projecting gripping elements 28 which cooperate with the internal annular bulge 40 to further function to constrain the chimney cap 10 from inadvertant displacement and removal from the upper open end of the chimney stack, the internal gripping elements 28 also cooperating with the bulge 40 to prevent wobbling of the chimney cap 10 relative to the upper open end of the chimney stack 52.

In essence, it is the sinusoidal arrangement of the inner and outer annular bulges 40 and 42 which function to frictionally engage and anchor the chimney cap 10 upon an upper open end of a chimney stack, whether the upper open end of the chimney stack has a diameter slightly larger than or slightly less than that of the cylindrical lower housing portion 16 of the chimney cap 10. Nevertheless, provision for further insuring against an inadvertant dislodging of the chimney cap 10 from the upper open end of a chimney stack is made in the form of the alternating inwardly and outwardly projecting gripping elements 28 and 30 at the lower-most portion of the lower housing portion 16.

It is the inwardly projecting gripping elements 28 that cooperate with the internal annular bulge 40 to prevent inadvertant dislodging when the chimney stack is of a diameter somewhat smaller than the internal diameter of the chimney cap 10. On the other hand, it is the provision of the outwardly projecting gripping elements 30 that cooperate with the outer annular bulge 42 to prevent inadvertant dislodging from a chimney stack having a diameter slightly larger than the outer diameter of the lower housing portion 16.

It will be noted that absolutely no moving parts are necessary for securing the chimney cap 10 of the present invention to the upper open end of a conforming chimney stack, the chimney cap 10 pursuant to the present invention being attachable reliably to the upper open end of a conforming chimney stack merely by the exertion of downward pressure against the chimney cap 10 to force it into or over and upon the upper open end of a conforming chimney stack.

What is claimed is:

1. A dual fitting chimney cap adapted to be connected to chimney stacks of differing sizes, said chimney cap comprising:

a) a cylindrical housing having an upper housing portion formed with a plurality of apertures, and a lower housing portion for attachment to an upper open end of a chimney stack of conforming cylindrical contour;

b) said lower housing portion having a cylindrical cross-section of a prescribed diameter;

c) annular transition means integrally interposed between and interconnecting said upper and lower housing portions;

d) said annular transition means including a first annular region and a second annular region integral with and interconnected to said first annular region, said first annular region having a prescribed diameter larger in dimension than the diameter of said second annular region and larger in dimension than the diameter of said lower housing portion;

e) said second annular region having a prescribed diameter smaller in dimension than the diameter of said lower housing portion;

f) said first annular region presenting an annular bulge extending outwardly of said cylindrical housing;

g) said second annular region presenting an annular bulge extending inwardly of said cylindrical housing, said lower housing portion including a generally circularly disposed array of internally projecting gripping elements equally spaced from one another each terminating in a free end, said lower housing portion including a generally circularly disposed array of outwardly projecting gripping elements equally spaced from one another each terminating in a free end, the individual outwardly projecting gripping elements each being interposed between a corresponding two of said inwardly projecting gripping elements.

2. A dual fitting chimney cap as claimed in claim 1, wherein said inwardly and outwardly projecting gripping elements alternate with one another circumferentially of said lower housing portion and are formed integral with the latter.

3. A dual fitting chimney cap as claimed in claim 1, wherein said annular bulge of said first annular region extends radially outwardly of said lower housing portion by an amount that is substantially the same as the amount that said annular bulge of said second annular region extends radially inwardly of said lower housing portion.

4. A dual fitting chimney cap as claimed in claim 1, wherein said first and second annular regions are contiguous with one another in sinusoidal relation.

* * * * *